US007306212B2

(12) United States Patent
Cantin

(10) Patent No.: US 7,306,212 B2
(45) Date of Patent: Dec. 11, 2007

(54) RATCHET CLAMP

(75) Inventor: Mark Cantin, Durham, NC (US)

(73) Assignee: BESSEY Tool GmbH & Co. KG, Bietigheim-Bissengen (DE)

( * ) Notice: Subject to any disclaimer, the term of this patent is extended or adjusted under 35 U.S.C. 154(b) by 0 days.

(21) Appl. No.: 11/333,389

(22) Filed: Jan. 17, 2006

(65) Prior Publication Data

US 2007/0052145 A1 Mar. 8, 2007

(30) Foreign Application Priority Data

Sep. 2, 2005 (DE) ..... 20 2005 014 171 U

(51) Int. Cl.
*B25B 1/00* (2006.01)

(52) U.S. Cl. ..... 269/6; 269/3; 269/95; 29/278; 29/268

(58) Field of Classification Search ..... 269/6, 269/3, 95; 29/268, 270, 278; 81/319–324, 81/407, 424, 427.5
See application file for complete search history.

(56) References Cited

U.S. PATENT DOCUMENTS

| | | | | |
|---|---|---|---|---|
| 3,241,410 | A * | 3/1966 | Paden | 81/370 |
| 4,944,204 | A | 7/1990 | West | |
| 5,408,904 | A | 4/1995 | Neff | |
| 6,026,716 | A | 2/2000 | Orlosky | |
| 6,237,449 | B1 | 5/2001 | Orlosky | |
| 6,578,452 | B2 * | 6/2003 | Duffy | 81/368 |
| 6,648,314 | B1 | 11/2003 | Degen et al. | |
| 6,711,789 | B2 * | 3/2004 | Ping | 24/505 |
| 7,007,937 | B2 * | 3/2006 | Foshag et al. | 269/6 |
| 2003/0019045 | A1 * | 1/2003 | Ping | 7/128 |
| 2003/0140425 | A1 * | 7/2003 | Ping | 7/128 |
| 2005/0087918 | A1 * | 4/2005 | Foshag et al. | 269/6 |
| 2006/0208407 | A1 * | 9/2006 | Wang | 269/6 |

FOREIGN PATENT DOCUMENTS

| | | |
|---|---|---|
| DE | 297 18 160 | 1/1998 |
| DE | 297 13 482 | 2/1998 |
| DE | 196 49 714 | 6/1998 |
| EP | 1 527 847 | 5/2005 |
| FR | 1 505 462 | 10/1966 |

OTHER PUBLICATIONS

Koller, R., et al., "Ein Weg zu einer systematischen Konstruktion und Ordnung von Schnappverbindungen", Konstruktion 39 (1987) H.8, pp. 315-320.

* cited by examiner

*Primary Examiner*—Lee D. Wilson
(74) *Attorney, Agent, or Firm*—Lipsitz & McAllister LLC

(57) ABSTRACT

A ratchet clamp is proposed, said clamp comprising a first limb with a first handle member and a first jaw member; a second limb with a second handle member and a second jaw member; a pivotal bearing for the relative pivotal movement of the first limb and the second limb; and a ratchet mechanism for fixing relative pivotal positions of the first limb and the second limb; wherein the first jaw member is mounted on the first limb in displaceable manner.

30 Claims, 3 Drawing Sheets

40
34
42
44
10
48
46
50
14
22
28
74
78
84
90
102
24
58
32
62
18
88
98
92
76
82
100
16
80
68
94
26
64
12
20

RATCHET CLAMP

The present disclosure relates to the subject matter disclosed in German utility model application number 20 2005 014 171.2 of Sep. 2, 2005, which is incorporated herein by reference in its entirety and for all purposes.

BACKGROUND OF THE INVENTION

The invention relates to a ratchet clamp comprising a first limb including a first handle member and a first jaw member, a second limb including a second handle member and a second jaw member, a pivotal bearing for enabling relative pivotal movement of the first limb and the second limb, and a ratchet mechanism for fixing relative pivotal positions of the first limb and the second limb.

Such ratchet clamps are used, in particular, as single-handed clamps for fixing work pieces together by means of a clamping action. Hereby, the work pieces are positioned between the first jaw member and the second jaw member which define a jaw, and a clamping effect is obtained by pivoting the limbs.

SUMMARY OF THE INVENTION

In accordance with the invention, a ratchet clamp is provided having great applications of use.

In accordance with the invention, the first jaw member is mounted on the first limb in displaceable manner.

Due to this displaceable manner of mounting the first jaw member on the first limb, there is then a further possibility for adjusting the jaw opening. As a result thereof, the jaw opening can be adjusted independently of the pivotal position of the two limbs relative to one another. Thus, for example, it is also then possible to clamp together work pieces of greater thicknesses.

In particular, the first limb and the second limb are formed in such a way and they are mounted relative to one another by means of the pivotal bearing such that the jaw opening between the first jaw member and the second jaw member is reduced by the movement of the first handle member and the second handle member towards one another. Consequently, the work pieces can be clamped between the jaw members by pivoting the first limb and the second limb towards one another. As a result thereof, single-handed operation in particular can be realized.

For the same reason, it is expedient if the first limb and the second limb are formed in such a way and are mounted relative to one another by means of the pivotal bearing such that the jaw opening between the first limb and the second limb is made larger by the movement of the first handle member and the second handle member away from one another.

It is especially very advantageous, if the first limb and the second limb are formed in such a manner and are mounted on one another by means of the pivotal bearing such that the first handle member and the second handle member can be gripped with one hand. Single-handed operation can thereby be realized. A ratchet clamp capable of clamping work pieces together whereby the clamping movements of the ratchet clamp are feasible with one hand can thus be provided. The user can then use his other hand for holding the work pieces for example.

In particular, the pivotal bearing is arranged on the first limb between the first handle member and the first jaw member. The pivotal bearing can thus be formed in a simple manner. Furthermore, simple fabrication of the ratchet clamp is ensured.

For the same reason, it is expedient if the pivotal bearing is arranged on the second limb between the second handle member and the second jaw member.

It is especially very advantageous, if the first jaw member is displaceable in a direction that is transverse relative to a pivotal axis of the pivotal bearing. In consequence, the jaw opening can also be adjusted by the displacement of the position of the first jaw member on the first limb so that extended fields of application thereby arise.

In particular, a slide rail is arranged on the first handle member of the first limb, the first jaw member being guided on said slide rail in displaceable manner. The jaw opening can be set by adjusting the position to which the member is displaced.

It is expedient, if the slide rail is seated on the first handle member in one-piece manner. The ratchet clamp can thus be manufactured in a simple manner.

In particular, the slide rail extends transversely relative to the first handle member. A large setting range for the width of the jaw can thus be realized.

It is expedient for a jaw opening to be adjustable by the displacement of the position of the first jaw member on the slide rail. In consequence, the setting of the jaw opening is no longer coupled directly to the pivotal position of the first limb and the second limb. For example, it is also then possible to clamp larger work pieces between the jaw members.

It is expedient for the position to which the first jaw member has been displaced on the slide rail to be capable of being fixed in order to permit setting of the jaw opening in a defined manner. A maximum jaw opening is defined by fixing one position of displacement. By virtue of the pivotal movement of the first limb and the second limb towards one another, this jaw opening can be made smaller and thereby exerts a clamping force on the work pieces between the first jaw member and the second jaw member.

Positions of displacement are adapted to be fixed by means of a latching connection for example. By virtue of such a latching connection, automatic retention of a particular position of displacement is effected so that the application of force is required in order to depart from a fixed position of displacement.

For example, the slide rail comprises a row of latching recesses and the first jaw member comprises at least one latching element which is adapted to enter a latching recess. A position of displacement of the first jaw member on the slide rail can be fixed by means of a latching element engaging in a latching recess.

In one embodiment, the first jaw member comprises at least one retaining tongue by means of which the at least one latching element can be held in a latching recess. The retaining tongue serves to ensure that the latching element is pressed into a corresponding latching recess in order to secure the position of displacement of the first jaw member on the slide rail. In particular, the retaining tongue presses the latching element into the corresponding latching recess by means of a resilient force. By overcoming this resilient force, the latching element can be extracted from the latching recess and the first jaw member can then be displaced on the slide rail.

It is expedient, if a first seating element for a work piece is mounted on the first jaw member in pivotal manner. Seating of the first jaw member on a work piece is thereby ensured in any arbitrary position of displacement of the first jaw member and in any arbitrary pivotal position of the two limbs.

For the same reason, it is expedient if a second seating element is mounted on the second jaw member in pivotal manner.

In particular, provision is made for the first handle member of the first limb and the second jaw member of the second limb to be located on the same side with respect to a central plane of the ratchet clamp in which a pivotal axis of the pivotal bearing is located, and for the second handle member of the second limb and the first jaw member of the first limb to be located on the same side. In consequence, a ratchet clamp can be realized with the aid of which a clamping force is adapted to be applied between the jaw members by means of a pivotal movement of the limbs towards one another.

Provision may be made for a spring and in particular a spiral spring to be arranged on the pivotal bearing for the purposes of moving the first jaw member and the second jaw member apart. It is thereby ensured that the first limb and the second limb will not move apart automatically and thus cause the jaw to be opened when the ratchet mechanism is engaged.

It is expedient if the first limb is made of a synthetic material. A corresponding ratchet clamp can thereby be manufactured in a simple and economical manner. The self-elasticity of the synthetic material (plastics material) can also be used in order to obtain an adequate clamping effect.

For the same reason, it is expedient if the second limb is made of a synthetic material (plastics material).

In one embodiment, the ratchet mechanism comprises a toothed strip which is arranged on one handle member, and a pawl mechanism which is arranged on the other handle member. A pivotal position can be fixed by the engagement of corresponding teeth of the pawl mechanism on the toothed strip. The clamping of the work pieces between the first jaw member and the second jaw member can thereby be secured.

In one embodiment, the pawl mechanism comprises an actuating lever which is pivotal. The teeth of the pawl mechanism can be lifted out of engagement from the toothed strip by the actuating lever and hence the ratchet mechanism can be released from its fixing position.

It is expedient for the actuating lever to be spring-loaded, whereby the spring action presses the pawl mechanism onto the toothed strip. The spring action must be overcome in order to release the arrangement from the fixing position thereof.

It is especially very advantageous, if the pawl mechanism comprises a pawl element which is arranged on the actuating lever in moveable manner. Secure fixing of a pivotal position is thus attainable, whereby this fixture of the position is releasable in a simple manner. If the teeth of the pawl element on the pawl mechanism are in engagement, then, due to the relative mobility between the pawl element and the actuating lever, the actuating lever can pivot and thereby be supported on the pawl element. It can thus be brought out of engagement more easily.

For example, the pawl element has a recess into which there is inserted a pin element that is seated on the actuating lever. Thus, relative movement between the actuating lever and the pawl element can be realized in a simple manner; the recess is of greater dimensions than a corresponding outer diameter of the pin element.

It is expedient for the pawl mechanism to comprise a plurality of teeth which engage in the interdental spaces of the toothed strip. Secure fixing can thereby be achieved.

In particular, the toothed strip and the pawl mechanism are matched to one another in such a way that pivoting of the first handle member and the second handle member away from one another is blocked when the pawl mechanism is in engagement with the toothed strip. Secure fixing can thereby be achieved.

Preferably, the toothed strip and the pawl mechanism are matched to one another in such a way as to enable pivotal movement of the first handle member towards the second handle member to be effected. In consequence, work pieces can be clamped between the first jaw member and the second jaw member in a simple manner. The limbs can be moved towards one another until such time as this movement towards one another is blocked by one or more work pieces between the jaw members. The ratchet mechanism permits such motion towards one another, whereas pivotal movement away from one another is blocked. A clamping position can thus be secured automatically, whereby a large clamping force is adapted to be exerted.

It is particularly expedient for the second limb to be formed in one-piece manner. It can then be made in a simple manner, for example, of a synthetic material.

Provision may also be made for the second jaw member to be guided on the second limb in displaceable manner, just as the first jaw member is guided on the first limb in displaceable manner. A particularly large jaw opening can thus be realized.

The following description of preferred embodiments serves for a more detailed explanation of the invention taken in conjunction with the drawing.

DETAILED DESCRIPTION OF THE INVENTION

Figure 1:
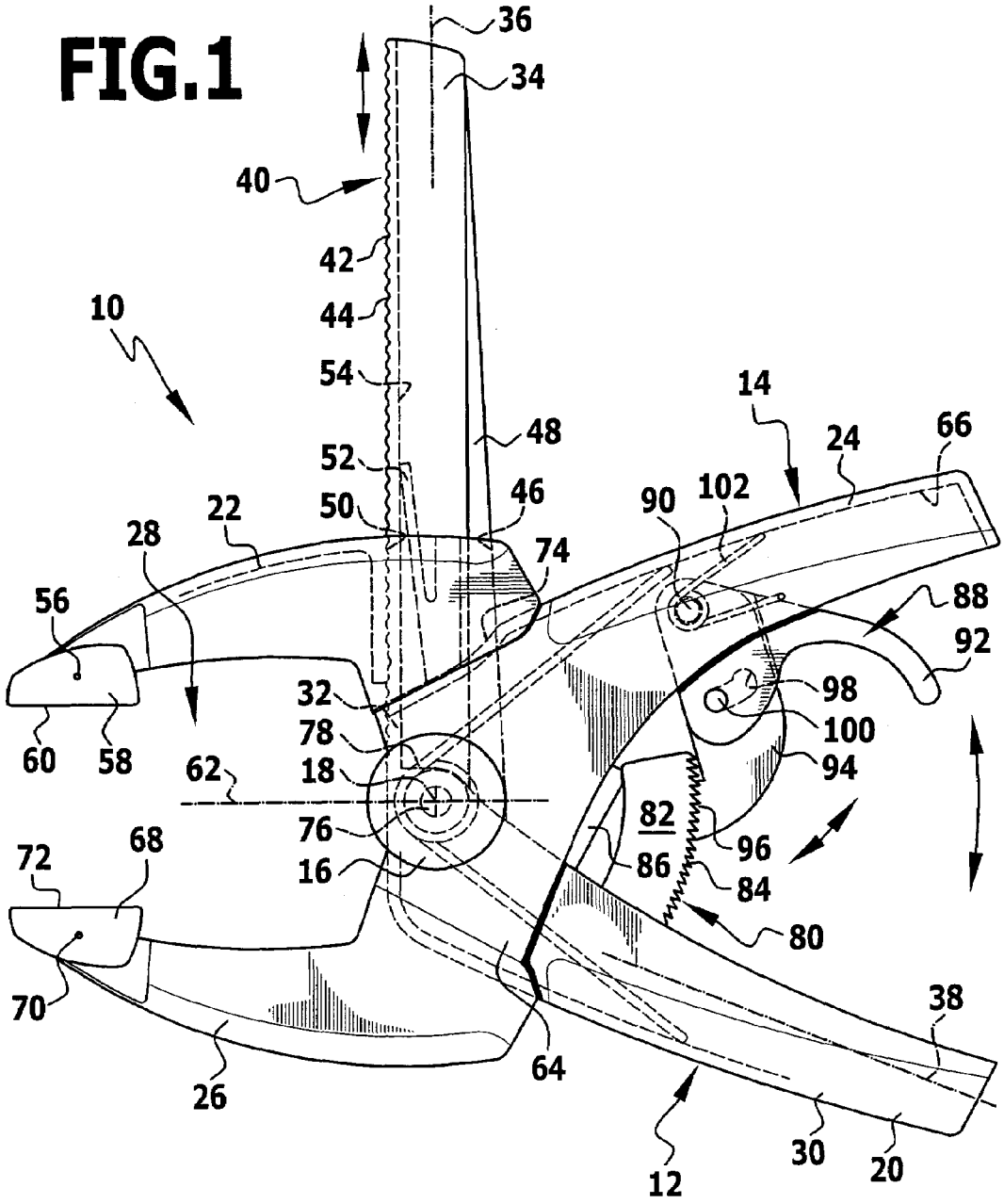
FIG. 1 shows a first exemplary embodiment of a ratchet clamp in accordance with the invention with an opened jaw.
Figure 2:
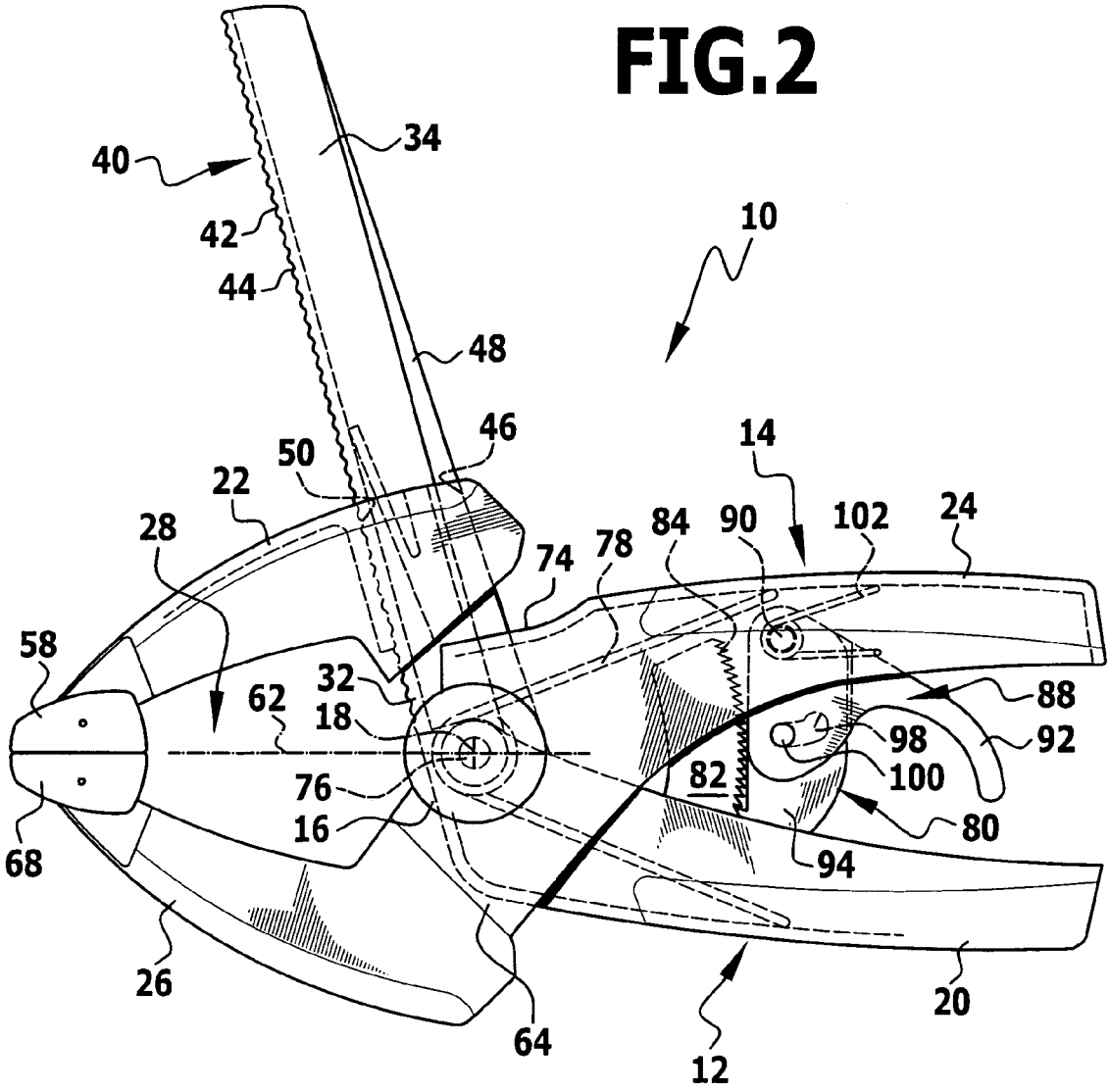
FIG. 2 the ratchet clamp in accordance with FIG. 1 with a closed jaw.

A first exemplary embodiment of a ratchet clamp in accordance with the invention which is shown in FIGS. 1 and 2 and is designated by 10 therein comprises a first limb 12 and a second limb 14. The two limbs 12, 14 are mounted on one another in pivotal manner by means of a pivotal bearing 16 having a pivotal axis 18.

The first limb 12 comprises a first handle member 20 and a first jaw member 22. The second limb 14 comprises a second handle member 24 and a second jaw member 26.

A jaw 28 is formed by the first jaw member 22 and the second jaw member 26, the jaw opening being adjustable by means of the relative pivotal position of the first limb 12 and the second limb 14 with respect to one another. The jaw opening of the jaw 28, i.e. the spacing between the first jaw member 22 and the second jaw member 26, is reduced by a pivotal movement of the first handle member 20 towards the second handle member 24 (FIG. 2). The jaw opening of the jaw 28 is increased when the first handle member 20 is pivoted away from the second handle member 24 (FIG. 1).

The ratchet clamp 10 is designed, in particular, as a single-handed clamp so that the user can grasp the first handle member 20 and the second handle member 24 with one hand and can then pivot the handle members 20, 24 towards one another or away from one another.

The outer surface 30 of the first handle member 20 has rounded-off edges so that the user can grasp the first handle member 20. In particular, the outer surface 30 is smooth.

The part of the first handle member 20 facing the second handle member 24 may be channel-shaped, whereby reinforcing ribs could be disposed in a corresponding interior space (not shown in the drawing).

The first limb 12 comprises a connecting portion 32 which adjoins the first handle member 20. The pivotal bearing 16 is arranged on the connecting portion 32. Furthermore, a slide rail 34, which extends in a direction 36 that is transverse and in particular perpendicular to the pivotal axis 18, is arranged on the connecting portion 32. The first jaw member 22 is guided in displaceable manner on this slide rail 34 in a direction parallel to the direction 36.

The slide rail 34 is seated, in particular, in one-piece manner on the connecting portion 32 which is connected to the first handle member 20, in particular again, in one-piece manner.

The direction 36 in which the slide rail 34 extends is oriented transversely relative to a longitudinal direction 38 of the first handle member 20. In the exemplary embodiment shown, the angle between the direction 36 of the slide rail and the longitudinal direction 38 of the first handle member 20 is somewhat greater than 90°. For example, it may be approximately 120°.

The jaw opening as being the spacing between the first jaw member 22 and the second jaw member 26 is adjustable independently of the pivotal position between the first limb 12 and the second limb 14 by means of an appropriate displacement of the position of the first jaw member 22 on the slide rail 34. The corresponding positions of displacement of the first jaw member 22 on the slide rail 34 are adapted to be fixed thereby.

The retention of the first jaw member 22 on the slide rail 34 is effected in particular by a latching connection. To this end, the slide rail 34 comprises a row 40 of latching recesses 42. These latching recesses 42 are arranged on a side-face 44 of the slide rail 34 which is remote from the first handle member 20. For the purposes of forming the latching recesses 42, the side-face 44 is formed with depressions, grooved for example (in the manner of a corrugated sheet).

The first jaw member 22 comprises a recess 46 by means of which it is seated on the slide rail 34 and is guided thereon. The slide rail 34 is inserted through this recess 46.

The slide rail 34 is in the form of a hollow profile and, for example, has a cross section in the form of a capital letter E incorporating a central guide web 48. The recess 46 is appropriately matched to this shape of the slide rail 34.

In the recess 46 thereof, the first handle member 20 comprises a latching element 50, in particular, in the form of a latching nose which can enter a latching recess 42 in the slide rail 34. Hereby, the latching element 50 is arranged on the recess 46 such as to be facing the side-face 44 of the slide rail 34.

Opposite thereto, one or more resilient retaining tongues 52 are arranged on the first jaw member 22 and press against an inner face 54 of the slide rail 34 which is located on the opposite side to the side-face 44. For example, there are provided a first retaining tongue and a second retaining tongue which are positioned in an interior portion of the slide rail 34 on both sides with respect to the guide web 48.

The spring action of the retaining tongue 52 ensures that the latching element 50 is pressed into a corresponding latching recess 42 so that the corresponding position of displacement of the first jaw member 22 on the slide rail 34 is fixed. The spring action of the retaining tongue 52 must be overcome by the user in order to allow the latching element 50 to be withdrawn from the corresponding latching recess 42.

The first jaw member 22 is curved for example. It is made, in particular, of a synthetic material. A first seating element 58 is mounted at the front end thereof such as to be pivotal about a pivotal axis 56. The first seating element 58 has a substantially flat contact surface 60 for a work piece. It is exchangeable; for example, it can be latched onto the first jaw member 22. Consequently, a seating element 58 that is matched to a work piece in terms of shape and length can be used.

The ratchet clamp 10 has a central plane 62 which extends through the pivotal axis 18 of the pivotal bearing 16. When the jaw 28 is closed (FIG. 2), the contact surface 60 is located substantially in the central plane 62. The first handle member 20 and the first jaw member 22 are located on different sides with respect to this central plane 62.

The second limb 14 comprises a connecting portion 64 which is connected in one-piece manner to the second handle member 24 and the second jaw member 26. The pivotal bearing 16 is arranged in the connecting portion 64. Hereby, the connecting portion 64 extends transversely relative to the second jaw member 26 and to the second handle member 24.

The second handle member 24 is formed with a curved smooth exterior surface in a similar manner to the first handle member 20. Furthermore, it comprises a trough-shaped interior 66 in which reinforcing ribs can be arranged.

The second limb 14 is made, in particular, of a synthetic material.

The second jaw member 26 corresponds in shape to the first jaw member 22. It is, in particular, curved. A second seating element 68 is seated at the front end thereof such as to be pivotal about a pivotal axis 70. The second seating element 68 has a substantially flat contact surface 72 for a work piece. When the jaw 28 is closed, the contact surface 72 is located substantially in the central plane 62. The second seating element 68 is also exchangeable; for example, it may be latched onto the second jaw member 26.

The second handle member 24 and the second jaw member 26 are located on different sides with respect to the central plane 62, whereby the first jaw member 22 and the second handle member 24 lie on the same side with respect to the central plane 62, whilst the second jaw member 26 and the first handle member 20 are located on the opposite side with respect to the central plane 62.

The second limb 14 comprises a recess 74 in the connecting portion 64, the slide rail 34 being inserted through said recess. The recess 74 is formed in such a way that the pivotal movement of the first limb 12 and the second limb 14 relative to one another is not handicapped by the slide rail 34. Hereby, the recess 74 can be formed in such a manner that a maximum pivotal position between the first handle member and the second handle member 24 is defined by virtue of the second limb 14 resting on the slide rail 34 via the wall delimiting the recess 74.

The respective connecting portions 32, 64 of the first limb 12 and the second limb 14 are mutually matched in order to enable a pivotal movement to be effected. For example, the thickness of the second limb 14 in the connecting portion 64 thereof is reduced in comparison with the second jaw member 26 and the second handle member 24 in order to provide a region within which the connecting portion 32 of the first limb 12 is movable. In the same way, the first limb 12 has a lesser thickness in the connecting portion 32 thereof than that of the first handle member 20 and the first jaw member 22.

The pivotal bearing 16 is arranged in the connecting portion 32 of the first limb 12 and the connecting portion 64 of the second limb 14, whereby it is arranged between the first handle member 20 and the first jaw member 22 and is also arranged between the second handle member 24 and the second jaw member 26. For example, it comprises a pivotal shaft 76 which is arranged on one limb, for example on the first limb 12, in mutually non-rotatable manner and is arranged on the other limb, for example the second limb 14, in rotatable manner.

Hereby, provision can be made for a spring 78 such as a spiral spring for example to be seated on the pivotal shaft 76. This is arranged and formed in such a way that it serves to open the jaw 28 if free pivotal movement of the two limbs 12 and 14 relative to one another has been made possible. The spring 78 thus ensures that the two handle members 20 and 24 will be pressed apart.

A ratchet mechanism 80 is provided for retaining a pivotal position between the first limb 12 and the second limb 14 and thus for the establishment of a certain jaw opening of the jaw 28 (if a position of displacement of the first jaw member 22 on the slide rail 34 has likewise been fixed).

The ratchet mechanism 80 comprises a curved toothed strip 82 which is arranged on the first limb 12 on an inner face of the first handle member 20.

The toothed strip 82 comprises teeth 84, whereby the tips of the teeth do not lie along a straight line, but rather, along a curved line. Interdental spaces are located between the neighbouring teeth.

Provision may be made for the toothed strip 82 to be additionally supported on the first limb 12 by means of a supporting element 86.

A pawl mechanism 88 is arranged on the second limb 14. This is arranged, in particular, on an inner face of the second handle member 24.

The pawl mechanism 88 is pivotal about a pivotal axis 90. The pivotal axis 90 is parallel to the pivotal axis 18 of the pivotal bearing 16. The pawl mechanism 88 comprises an actuating lever 92 which is positioned between the first handle member 20 and the second handle member 24 and thereby, it is arranged and formed in such a way that it does not strike against the second handle member 24 even when the jaw 28 closed (FIG. 2).

The pawl mechanism 88 comprises a pawl element 94 having a plurality of teeth 96 which are adapted to engage in the interdental spaces of the toothed strip 82. The pawl element 94 is moveable with respect to the actuating lever 92. To this end, it comprises a recess 98 into which a pin element 100 of the actuating lever 92 is inserted. The actuating lever thus surrounds the pawl element 94 in this region. By virtue of the pin element 100, the pawl element 94 is held on the control element 92 such that it cannot be lost, whereby the recess 98 has larger geometrical dimensions than the outer diameter of the pin element 100. The freedom of movement of the pawl element 94 on the actuating lever 92 is defined by this design of the recess 98.

The pawl mechanism 88 is spring-loaded by a spring 102 at the position where it is mounted on the second handle member 24. The spring 102 is arranged and formed in such a way that it presses the teeth 96 of the pawl mechanism 88 against the toothed strip 82. The spring action must be overcome in order to pivot the pawl mechanism 88 out of engagement.

By appropriately matching the toothed strip 82 and the teeth 96, the ratchet mechanism is formed in such a way as to enable the first handle member to be moved towards the second handle member 24 insofar as the movement of the first jaw member 22 towards the second jaw member 26 is not blocked by one or more work pieces in the jaw 28. A clamping force can thereby be exerted. By contrast, movement of the first handle member 20 away from the second handle member 22, i.e. the pivotal movement of the first limb 12 away from the second limb 14 is blocked by the meshing action of the teeth. This engagement can only be removed by an outward pivotal movement of the pawl mechanism 88.

A locking engagement in the manner of an undercut-type of interengagement with regard to movement of the first limb 12 away from the second limb 14 is provided by the meshing action of the teeth. The freedom of movement of the pawl element 94 relative to the actuating lever 92 resulting from the design of the recess 98 is such that the actuating lever 92 can initially be supported on the pawl element 94 in order to move the second handle member 24, for example, by virtue of its self-elasticity and/or by a slight degree of pivotal movement of the second limb 14 relative to the first limb 12. The undercut-type of interengagement can thereby be released and the teeth 96 of the pawl element 94 brought out of engagement in order to enable the free pivotal movement between the two limbs 12 and 14 to be restored.

The ratchet clamp 10 in accordance with the invention functions as follows:

In an open position (FIG. 1), the two limbs 12, 14 are pivoted apart, i.e. the first handle member 20 and the second handle member 24 are at a correspondingly greater distance from the central plane 62. If the two limbs 12, 14 are moved towards one another by moving the handle members 20 and 24 towards one another, then the jaw-width of the jaw 28 is reduced and a work piece can be clamped between the seating elements 58 and 68. Additionally thereby, the jaw opening can be adjusted by displacing the position of the first jaw member 22 on the slide rail 34. The setting of the jaw opening can thus be decoupled from the pivotal position of the limbs 12 and 14 relative to one another, i.e. the jaw width does not have to correlate with the pivotal position of the limbs 12, 14.

During the movement of the limbs 12 and 14 towards one another, the teeth 96 of the pawl element 94 are in engagement with the toothed strip 92, whereby a movement of the first handle member 20 towards the second handle member 24 is permitted, although movement away from one another is blocked. In consequence, a pivotal position and hence a clamping position are automatically secured.

For the purposes of releasing a clamping position, the actuating lever 92 is pivoted towards the second handle member 24. In the first stage of this pivotal movement, the actuating lever 92 can support itself by means of its pin element 100, which is guided in the recess 98, on the pawl element 94 (its teeth 96 being in engagement with the toothed strip 82 of course) and thereby produce a movement of the second handle member 24 (for example, a pivotal movement and/or a resilient movement) which is such that the engagement of the teeth 96 in the toothed strip 82 is released.

Due to the spring 78, the two limbs 12 and 14 are then moved apart until the maximum pivotal position is reached.

Figure 3:
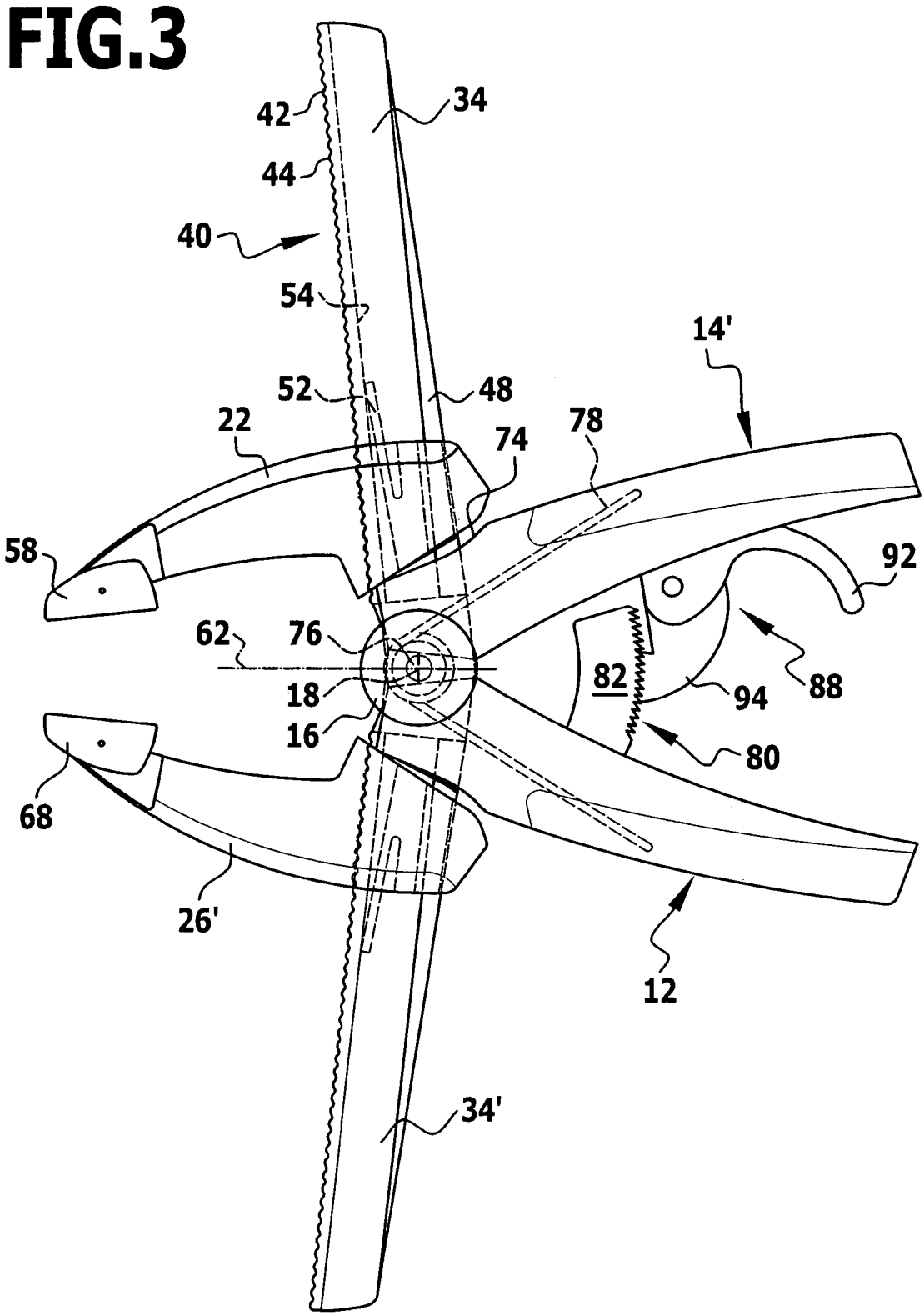
FIG. 3 a second exemplary embodiment of a ratchet clamp in accordance with the invention (with an opened jaw).

In a second exemplary embodiment which is shown in FIG. 3, there is provided a second jaw member 26' which is displaceable on a second limb 14'. Basically hereby, the first limb 12 is formed in the same manner as was described above in connection with the first exemplary embodiment; the same reference symbols are used for the same elements.

The second limb 14' comprises a slide rail 34' on which the jaw member 26' is displaceable. The slide rail 34' is oriented on that side with respect to the central plane 62, on which the first jaw member 26' and the first handle member 20 of the first limb 12 are located.

The manner of displacing and retaining the position of displacement of the second jaw member 26' is effected in the same way as that used for the displacement of the first jaw member 22 on the slide rail 34.

A larger number of ways of making an adjustment ensue as a result of the provision of displaceability for both the first jaw member 22 (on the first limb 12) and the second jaw member 26' (on the second limb 14'). In particular, the jaw can be adjusted to a very large opening, which corresponds in the maximum case to the distance between the maximum position of displacement of the first jaw member 22 on the slide rail 34 and the maximum position of displacement of the second jaw member 26' on the slide rail 34'. Consequently, very thick work pieces in particular can also be clamped between the jaw members 22 and 26'.

The invention claimed is:

1. A ratchet clamp, comprising:

a first limb with a first handle member and a first jaw member;

a second limb with a second handle member and a second jaw member;

a common pivotal bearing for the relative pivotal movement of the first limb and the second limb; and a ratchet mechanism for fixing relative pivotal positions of the first limb and the second limb; and a slide rail arranged on the first handle member of the first limb, the first jaw member being guided on said slide rail in a displaceable manner.

2. A ratchet clamp in accordance with claim 1, wherein a jaw opening between the first jaw member and the second jaw member is reduced by movement of the first handle member and the second handle member towards one another.

3. A ratchet clamp in accordance with claim 1, wherein a jaw opening between the first jaw member and the second jaw member is increased by movement of the first handle member and the second handle member away from one another.

4. A ratchet clamp in accordance with claim 1, wherein the first limb and the second limb are formed in such a manner and are mounted on one another by means of the pivotal bearing such that the first handle member and the second handle member are adapted to be gripped with one hand.

5. A ratchet clamp in accordance with claim 1, wherein the pivotal bearing is arranged on the first limb between the first handle member and the first jaw member.

6. A ratchet clamp in accordance with claim 1, wherein the pivotal bearing is arranged on the second limb between the second handle member and the second jaw member.

7. A ratchet clamp in accordance with claim 1, wherein the first jaw member is displaceable in a direction which is transverse relative to a pivotal axis of the pivotal bearing.

8. A ratchet clamp in accordance with claim 1, wherein the slide rail is seated on the first handle member in a one-piece manner.

9. A ratchet clamp in accordance with claim 1, wherein the slide rail extends transversely relative to the first handle member.

10. A ratchet clamp in accordance with claim 1, wherein ajaw opening is adjustable by displacement of the first jaw member on the slide rail.

11. A ratchet clamp in accordance with claim 1, wherein positions of displacement of the first jaw member on the slide rail are adapted to be fixed.

12. A ratchet clamp in accordance with claim 11, wherein the positions of displacement are adapted to be fixed by means of a latching connection.

13. A ratchet clamp in accordance with claim 12, wherein the slide rail has a row of latching recesses and the first jaw member has at least one latching element which is adapted to enter a latching recess.

14. A ratchet clamp in accordance with claim 13, wherein the first jaw member has at least one retaining tongue by means of which the at least one latching element can be held in a latching recess.

15. A ratchet clamp in accordance with claim 1, wherein a first seating element is mounted on the first jaw member in pivotal manner.

16. A ratchet clamp in accordance with claim 1, wherein a second seating element is mounted on the second jaw member in pivotal manner.

17. A ratchet clamp in accordance with claim 1, wherein, with respect to a central plane of the ratchet clamp in which a pivotal axis of the pivotal bearing is located, the first handle member of the first limb and the second jaw member of the second limb are located on a first side, and the second handle member of the second limb and the first jaw member of the first limb are located on a second side.

18. A ratchet clamp in accordance with claim 1, wherein a spring is arranged on the pivotal bearing for moving the first jaw member and the second jaw member apart.

19. A ratchet clamp in accordance with claim 1, wherein the first limb is made of a synthetic material.

20. A ratchet clamp in accordance with claim 1, wherein the second limb is made of a synthetic material.

21. A ratchet clamp in accordance with claim 1, wherein the ratchet mechanism comprises a toothed strip which is arranged on the first handle member, and also comprises a pawl mechanism which is arranged on the second handle member.

22. A ratchet clamp in accordance with claim 21, wherein the pawl mechanism comprises an actuating lever which is pivotal.

23. A ratchet clamp in accordance with claim 22, wherein the actuating lever is spring-loaded, whereby a spring action of the actuating lever presses the pawl mechanism onto the toothed strip.

24. A ratchet clamp in accordance with claim 22, wherein the pawl mechanism comprises a pawl element which is arranged on the actuating lever in moveable manner.

25. A ratchet clamp in accordance with claim 24, wherein the pawl element has a recess into which there is inserted a pin element that is seated on the actuating lever.

26. A ratchet clamp in accordance with claim 21, wherein the pawl mechanism comprises a plurality of teeth for engagement in the interdental spaces of the toothed strip.

27. A ratchet clamp in accordance with claim 21, wherein the toothed strip and the pawl mechanism are adapted such that pivotal movement of the first handle member and the second handle member away from one another is blocked when the pawi mechanism is in engagement with the toothed strip.

28. A ratchet clamp in accordance with claim 21, wherein the toothed strip and the pawl mechanism are adapted to enable pivotal movement of the first handle member and the second handle member towards one another.

29. A ratchet clamp in accordance with claim 1, wherein the second limb is formed in a one-piece manner.

30. A ratchet clamp in accordance with claim 1, wherein the second jaw member is guided on the second limb in displaceable manner.

* * * * *

UNITED STATES PATENT AND TRADEMARK OFFICE

CERTIFICATE OF CORRECTION

PATENT NO. : 7,306,212 B2
APPLICATION NO. : 11/333389
DATED : December 11, 2007
INVENTOR(S) : Cantin It is certified that error appears in the above-identified patent and that said Letters Patent is hereby corrected as shown below:

Column 10, line 5: “ajaw” should read -- a jaw --.

Column 11, line 2: “pawi” should read -- pawl --.

Signed and Sealed this

Twenty-ninth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,306,212 B2
APPLICATION NO. : 11/333389
DATED : December 11, 2007
INVENTOR(S) : Cantin It is certified that error appears in the above-identified patent and that said Letters Patent is hereby corrected as shown below:

On the Title Page (73) of the patent, the Assignee's residence is corrected to read:
--Bietigheim-Bissingen (DE)--

Signed and Sealed this

Twenty-second Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,306,212 B2
APPLICATION NO. : 11/333389
DATED : December 11, 2007
INVENTOR(S) : Cantin It is certified that error appears in the above-identified patent and that said Letters Patent is hereby corrected as shown below:

On the front of the patent, the Assignee's residence is corrected to read:
--Bietigheim-Bissingen (DE)--

Signed and Sealed this

Twelfth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,306,212 B2
APPLICATION NO. : 11/333389
DATED : December 11, 2007
INVENTOR(S) : Mark Cantin It is certified that error appears in the above-identified patent and that said Letters Patent is hereby corrected as shown below:

This certificate vacates the Certificate of Correction issued August 12, 2008. The certificates is a duplicate of the Certificate of Correction issued July 22, 2008. All requested changes were included in the Certificate of Correction issued July 22, 2008.

Signed and Sealed this

Twenty-fifth Day of November, 2008

JON W. DUDAS
*Director of the United States Patent and Trademark Office*